US009058021B2

(12) United States Patent
Cordier

(10) Patent No.: US 9,058,021 B2
(45) Date of Patent: Jun. 16, 2015

(54) REGULATING MEMBER INCLUDING A BALANCE, A BALANCE SPRING, A BALANCE SPRING STUD AND STUD HOLDER AND AN ASSEMBLY FORMED OF A BALANCE SPRING STUD AND A STUD HOLDER

(71) Applicant: Blancpain S.A., Le Brassus (CH)

(72) Inventor: Samuel Cordier, Gex (FR)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 14/276,087

(22) Filed: May 13, 2014

(65) Prior Publication Data

US 2014/0341001 A1 Nov. 20, 2014

(30) Foreign Application Priority Data

May 16, 2013 (EP) ..... 13168076

(51) Int. Cl.
*G04B 17/04* (2006.01)
*G04B 15/14* (2006.01)
*G04B 17/32* (2006.01)

(52) U.S. Cl.
CPC ..... *G04B 15/14* (2013.01); *G04B 17/325* (2013.01)

(58) Field of Classification Search
CPC ..... G04B 17/325; G04B 15/14; G04B 17/32
USPC ..... 368/131, 130, 175–178
See application file for complete search history.

(56) References Cited

U.S. PATENT DOCUMENTS

| | | | | |
|---|---|---|---|---|
| 1,037,741 | A * | 9/1912 | Dudley | 368/169 |
| 2,728,189 | A * | 12/1955 | Meyer | 368/173 |
| 3,016,688 | A * | 1/1962 | Rueger | 368/178 |
| 3,241,307 | A * | 3/1966 | Dickerman | 368/176 |
| 3,262,261 | A * | 7/1966 | Monnin | 368/178 |
| 2006/0062088 | A1 * | 3/2006 | Hintze et al. | 368/175 |

FOREIGN PATENT DOCUMENTS

| | | |
|---|---|---|
| CH | 76336 | 12/1917 |
| CH | 347769 | 7/1960 |
| CH | 368098 | 11/1962 |

OTHER PUBLICATIONS

European Search Report issued Nov. 25, 2013, in Patent Application No. EP 13 16 8076, filed May 16, 2013 (with English-language translation).

* cited by examiner

*Primary Examiner* — Sean Kayes
(74) *Attorney, Agent, or Firm* — Oblon, McClelland, Maier & Neustadt, L.L.P.

(57) ABSTRACT

The balance spring stud holder has a housing in the form of a groove arranged to longitudinally receive and position the stud. The housing is at least partially laterally closed by an elastic strip which is arranged to return the stud against the bottom of the groove so that the stud can be locked, when the stud is inserted into the housing between the elastic strip and the bottom of the groove.

8 Claims, 4 Drawing Sheets

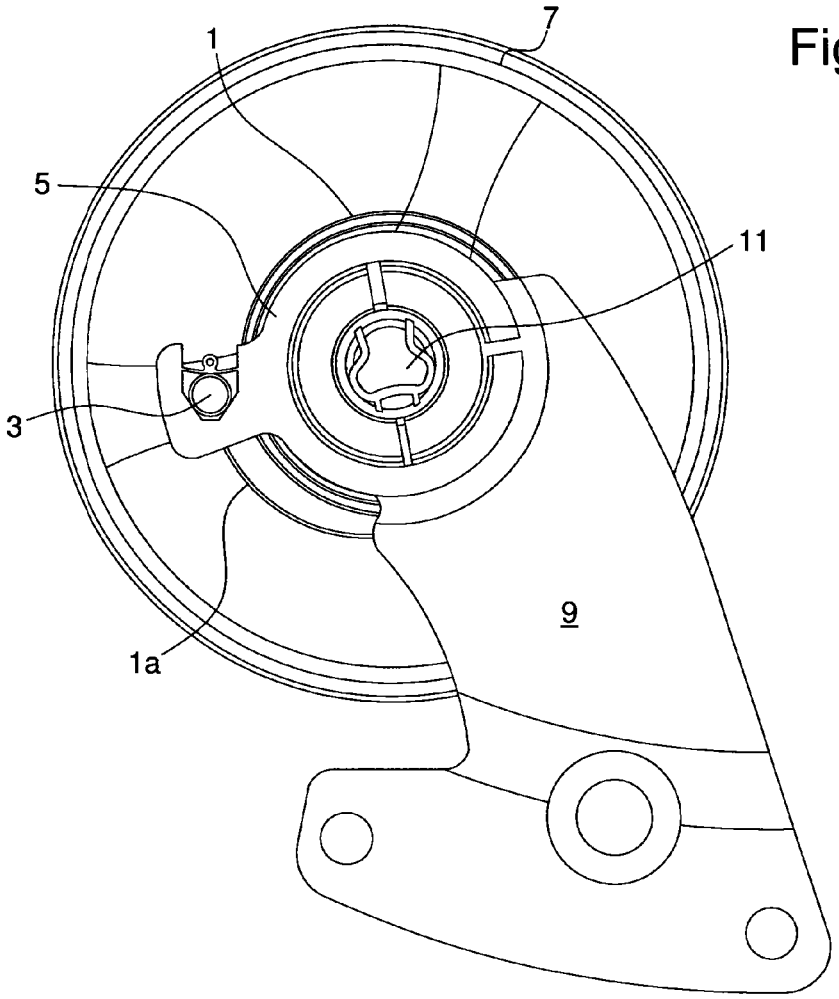
Fig. 3
Fig. 4
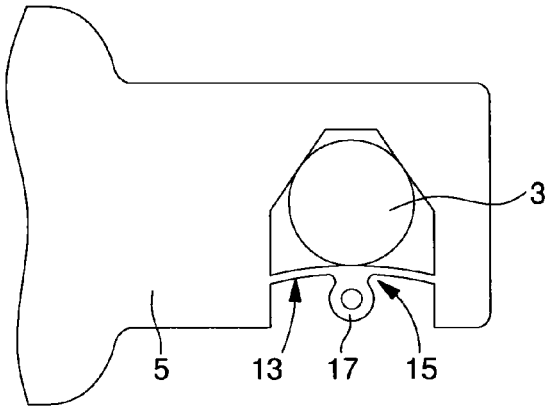

REGULATING MEMBER INCLUDING A BALANCE, A BALANCE SPRING, A BALANCE SPRING STUD AND STUD HOLDER AND AN ASSEMBLY FORMED OF A BALANCE SPRING STUD AND A STUD HOLDER

This application claims priority from European patent application No. 13168076.1 filed May 16, 2013, the entire disclosure of which is hereby incorporated by reference.

FIELD OF THE INVENTION

The present invention concerns a sprung balance regulating member for a timepiece including a balance, a balance spring, a balance spring stud and a balance spring stud holder, the balance spring having one end connected to the balance and being secured via the other end to the balance spring stud, the stud being in turn held rigidly in place by the stud holder. The present invention more specifically concerns the assembly formed by assembling the balance spring stud and the balance spring stud holder.

PRIOR ART

There are known regulating members including a balance and a balance spring wherein the inner end is rigidly fixed to a collet driven onto the balance staff, while the outer end of the balance spring is rigidly fixed to a balance spring stud carried by a stud holder angularly movable concentrically to the balance staff.

There are several known manners of fixing the outer end of the balance spring to a balance spring stud. One of these manners is illustrated in the annexed FIGS. 1 and 2. Firstly, the end of the balance spring (referenced 101) is inserted into a notch comprised in the balance spring stud 103. Then the balance spring is locked in the notch or hole by adhesive bonding. Stud 103 is then in turn inserted into a housing arranged in stud holder 105. A small screw 107 is also provided for immobilising the stud once the height thereof inside the housing has been adjusted.

The stud holder is pivoted with locational clearance fit on a portion of the balance cock (or balance bridge) concentric to the balance staff. As a result of this feature, a watchmaker can adjust the angular position of the stud and of the outer end of the balance spring simply by pivoting the stud holder in relation to the balance. This manipulation is important since the angular position of the outer end of the balance spring must be such that the impulse pin is on a line with the pallet lever and the balance when the balance is in its position of equilibrium.

The adjustment of the position of the balance spring in relation to the balance staff must be accurate. Indeed, any eccentricity of the balance spring or perpendicularity error in relation to the balance staff causes significant chronometric errors, in particular as regards the isochronism of the regulating member. The balance spring stud must therefore be perpendicular to the plane of the balance spring and positioned precisely to ensure concentric development of the balance spring. In practice, adjustment of the position of the stud is difficult, since access is limited and the parts concerned are of very small dimensions. With conventional balance springs made of metal alloy, once the outer end of the spring is fixed to the balance bridge by the stud and the stud holder, any residual deviations with respect to the ideal three-dimensional shape of the balance spring can still be corrected by plastic deformation of the end of the balance spring.

In the case where the balance spring is made of a brittle material, such as silicon, diamond or quartz, the above adjustment by plastic deformation is impossible. In these conditions, the use of a balance spring stud requires very tight manufacturing tolerances and a robust stud-spring assembly, so as to obtain the most perfect possible perpendicularity between the axis of the stud and the plane of the balance spring. It will be understood, without difficulty, that this essential requirement represents a major difficulty on the industrial scale, when it is known that simply immobilising the stud in its housing by tightening a screw may be sufficient to distort its orientation. Further, it is common for the tightening screw to be dropped and lost during the adjustment operation.

BRIEF SUMMARY OF THE INVENTION

It is an object of the present invention to overcome the drawbacks of the prior art which have just been mentioned by providing an assembly, formed of a balance spring stud and a balance spring stud holder, which offers the possibility of adjusting the position of the stud with respect to the stud holder and subsequently immobilising the stud more easily without using a screw. The present invention achieves this object by providing an assembly formed of a balance spring stud and a balance spring stud holder in accordance with the annexed claim 1.

BRIEF DESCRIPTION OF THE DRAWINGS

Other features and advantages of the invention will appear upon reading the following description, given solely by way of non-limiting example, with reference to the annexed drawings, in which:

FIG. 3 is a top, plan view showing a sprung balance regulating member according to a first embodiment of the invention.

FIG. 4 is a partial enlarged view of the regulating member of FIG. 3, more particularly showing the assembly of the balance spring stud and the stud holder.

DETAILED DESCRIPTION OF TWO EMBODIMENTS

Figure 1:
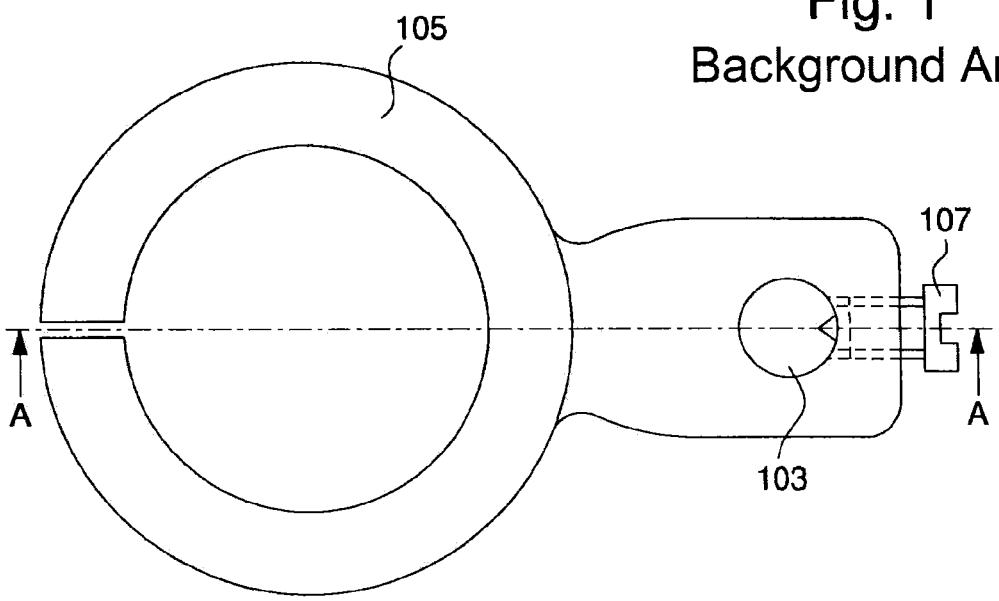
Fig. 1 Background Art
FIG. 1 is a schematic, plane view of a prior art assembly of a balance spring stud-stud holder.
Figure 2:
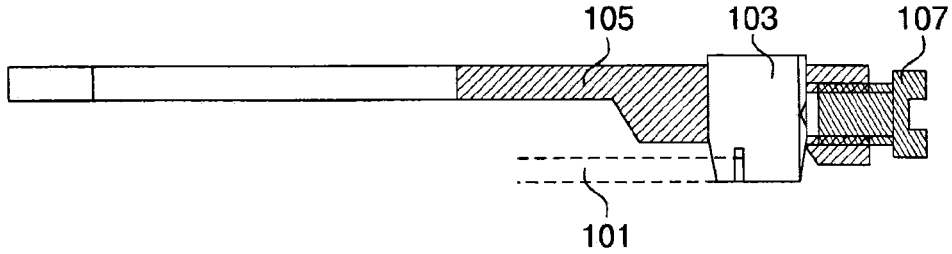
Fig. 2 Background Art
FIG. 2 is a cross-section along A-A of FIG. 1.

FIG. 3 shows a sprung balance regulating member for a timepiece corresponding to a particular embodiment of the invention. Referring to the Figure, there is shown a balance 7, whose staff is pivoted between two bearings. In a conventional manner, one of these bearings (referenced 11) is carried by the balance cock 9, while the other bearing is mounted in the main plate (not shown). Also in a conventional manner, the balance is associated with a balance spring 1, whose central end is fixed to the balance staff.

Balance cock 9 also serves as a support for an assembly formed by balance spring stud 3 and stud holder 5. This assembly is intended to position the outer end 1*a* of balance spring 1. In this example, end 1*a* is first of all rigidly secured to the stud by adhesive bonding. To achieve this, the end of the balance spring is first inserted into a notch (not shown) in the stud. The balance spring is then locked in the notch by adhesive bonding. It is specified that the invention is not limited to a particular method of fixing the end 1*a* of the balance spring to the stud. End 1*a* could equally be, for example, fixed to a conventional stud with a pin. Or, according to yet another variant, stud 3 and balance spring 1 could be made in a single piece.

In the present example, stud holder 5 is essentially formed of an annular portion concentric to the balance staff, and of an extension piece in the form of an arm which carries stud 3 and which extends radially with respect to balance staff 7 towards the outer coils of the balance spring. In a conventional manner, the extension piece of stud holder 5 has a housing 13 oriented parallel to balance staff 7 and into which the stud is longitudinally inserted. Further, stud holder 5 is pivoted with locational clearance fit via the annular portion thereof on a portion of balance cock 9 which is concentric to the balance. As a result of this feature, a watchmaker can modify the position of stud 3 simply by pivoting stud holder 5 with respect to the balance cock and the balance.

Referring again to FIG. 4, it is seen in the illustrated example that housing 13 is formed by a rectilinear groove which is closed over most of the length thereof by a thin flexible strip 15. Strip 15 is arranged to grip and lock stud 3 against the bottom of the groove by elastic pressure. FIG. 4 also shows that strip 15 is integral with the walls of the groove and extends with no discontinuity from one wall of the groove to the other. It is, however, specified that, according to other embodiments of the invention, the strip could be not integral with the stud holder, but fixed to the stud holder on both sides of the groove. It is also specified that the stud holder is preferably made of silicon, but that it could also be made of another material. By way of example, the stud holder could be made of metal, or even a composite material. If the stud is made of metal, it is preferably formed by electroplating using the LIGA technique.

According to the invention, strip 15 carries a hooking structure 17 arranged to allow a watchmaker to pull the strip backwards to release the stud. More specifically, when a watchmaker wishes to adjust the position of stud 3 with respect to stud holder 5, he can use a tool (not shown) adapted to cooperate with hooking structure 17. Thus, as a result of the hooking structure, the watchmaker can move elastic strip 15 out of the way and release the stud. It is to be recalled that strip 15 is fixed on both sides of the groove. Further, referring again to FIG. 4, it is seen that, according to the invention, the strip forms a curved arc towards the bottom of the groove. One advantage of this configuration is that it gives strip 15 two distinct stable positions. One of these positions is that which is shown in FIGS. 3 and 4. The second position corresponds to the situation where the curve of the strip is inverted; the strip then forming a curved arc towards the exterior of the groove. It will be understood from the foregoing that by moving strip 15 away from stud 3, the watchmaker will cause the strip to snap from its first to its second stable position, so that the strip will no longer be pressing against the stud. Since the second position is stable, it is not necessary to retain the strip subsequently during adjustment of the position of the stud. Once the stud has been correctly positioned, the watchmaker need only push the strip back towards the bottom of the groove, for the strip to snap back from its second to its first stable position, once again locking the stud.

According to this example, the shape of stud 3 is essentially cylindrical. One advantage linked to the inherent rotational symmetry of the cylindrical shape is that the position of the stud can be adjusted with respect to stud holder 5, not only longitudinally, but also in rotation. This additional possibility may prove advantageous when the balance spring is made of a brittle material. Indeed, when the spring is made of this type of material, it is, in principle, impossible to correct any deviation of the spring by plastic deformation of the end thereof. However, in the case where the possibility of adjustment in rotation is unnecessary, it is advantageously possible to use a stud having a flat portion (not shown) arranged to cooperate with the inner wall of housing 13, so as to angularly lock the stud.

Figure 5:
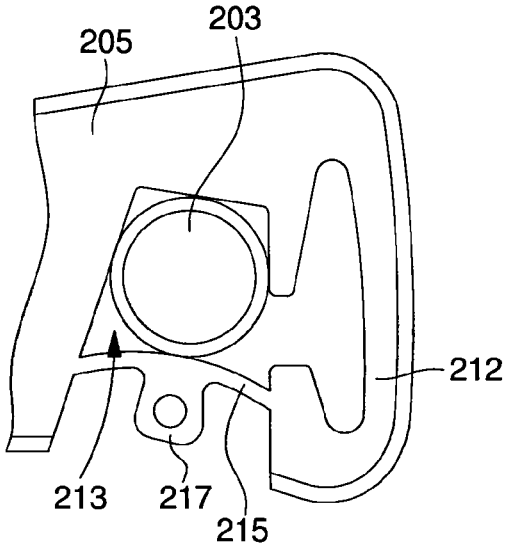
FIG. 5 is a partial enlarged view similar to FIG. 4, but showing a sprung balance regulating member according to a second embodiment of the invention.
Figure 6:
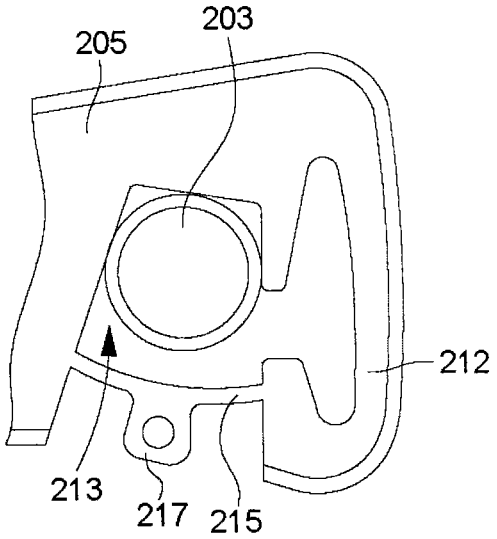
FIG.6 is a view showing a sprung balance regulating member according to the second embodiment of the invention with a strip in another position.

FIG. 5 is a partial enlarged view showing the assembly of a stud and a stud holder 205 forming part of a regulating member according to a second embodiment of the invention. In this second embodiment, as in the first, the strip 215 can occupy two distinct stable positions. It will be understood that the position shown in FIG. 5 is that in which the strip locks stud 203 against the bottom of the groove by elastic pressure. A housing 213 and a hooking structure 217 are also shown. The second position, shown in FIG. 6, corresponds to the situation in which the curve of the strip is inverted. Preferably, strip 215 is integral with one edge of the groove to which it is connected by one of its sides. In the embodiment illustrated, the other side of the strip is connected to a flexible arm, or spring 212, which is also integral with the rest of the stud holder. One advantage associated with the presence of flexible arm 212 is that it reduces the effort necessary to cause strip 215 to snap from one of its stable positions to the other, while still holding the strip buckled.

It will also be clear that various alterations and/or improvements evident to those skilled in the art may be made to the embodiment described herein without departing from the scope of the present invention defined by the annexed claims. In particular, the housing arranged in the stud holder for receiving the stud could, in a first variant, be a through hole. However, in another variant, this housing could be open on only one side of the balance spring.

What is claimed is:

1. An assembly formed of a balance spring stud holder and a balance spring stud, the stud holder having a groove-shaped housing arranged to longitudinally receive and position the stud, and the housing being at least partially closed laterally by an elastic strip, wherein a transverse profile of the elastic strip forms a curved arc connecting two sides of the groove-shaped housing, the elastic strip can occupy a first stable position in which the arc formed by the strip curves towards a bottom of the housing and a second stable position in which the arc curves in the opposite direction, the elastic strip being arranged to return the stud against the bottom of the housing so as to lock the stud when the stud is inserted between the elastic strip and the bottom of the housing.

2. The assembly formed of a balance spring stud holder and a balance spring stud according to claim 1, wherein the elastic strip also has a hooking structure configured to cooperate with a gripping tool so that it is possible to move the elastic strip away from the stud by means of the gripping tool in order to release the stud.

3. The assembly formed of a balance spring stud holder and a balance spring stud according to claim 1, wherein the housing has a transverse profile arranged so that there is only a limited number of points of contact between the stud and the inner wall of the housing when the stud is locked.

4. The assembly formed of a balance spring stud holder and a balance spring stud according to claim 1, wherein the groove-shaped housing is substantially rectilinear and oriented parallel to a balance staff.

5. The assembly formed of a balance spring stud holder and a balance spring stud according to claim 1, wherein the strip is attached to the stud holder on either side of the groove-shaped housing.

6. The assembly formed of a balance spring stud holder and a balance spring stud according to claim 1, wherein the elastic strip is integral with the balance spring stud holder.

7. The assembly formed of a balance spring stud holder and a balance spring stud according to claim 6, wherein the stud holder is made of silicon.

8. The assembly formed of a balance spring stud holder and a balance spring stud according to claim 6, wherein the stud holder is made of metal.

* * * * *